US005354354A

United States Patent [19]

Edeling et al.

[11] Patent Number: 5,354,354

[45] Date of Patent: Oct. 11, 1994

[54] METHOD FOR PRODUCING SINGLE-PHASE, INCONGRUENTLY MELTING INTERMETALLIC PHASES

[75] Inventors: Martin Edeling, Essen; Horst Eggert, Dorsten; Michael Steinhorst, Essen, all of Fed. Rep. of Germany

[73] Assignee: Th. Goldschmidt AG, Essen, Fed. Rep. of Germany

[21] Appl. No.: 955,952

[22] Filed: Oct. 2, 1992

[30] Foreign Application Priority Data

Oct. 22, 1991 [DE] Fed. Rep. of Germany ..... 4134793
Feb. 13, 1992 [DE] Fed. Rep. of Germany ..... 4204173

[51] Int. Cl.[5] ..... B22F 9/26

[52] U.S. Cl. ..... 75/351; 420/83; 420/121; 420/418; 148/101; 148/669

[58] Field of Search ..... 148/101, 121, 669; 420/83, 121, 418; 75/351

[56] References Cited

U.S. PATENT DOCUMENTS

| | | | |
|---|---|---|---|
| 3,918,933 | 11/1975 | Martin | 148/101 |
| 4,756,775 | 7/1988 | Croat | 148/302 |
| 4,767,450 | 8/1988 | Ishigaki et al. | 420/83 |
| 4,917,724 | 4/1990 | Sharma | 75/350 |

FOREIGN PATENT DOCUMENTS

| | | |
|---|---|---|
| 0039791 | 11/1981 | European Pat. Off. . |
| 0101552 | 2/1984 | European Pat. Off. . |
| 0249973 | 12/1987 | European Pat. Off. . |
| 0369097 | 5/1990 | European Pat. Off. . |

OTHER PUBLICATIONS

"Technological & Economic Aspects of Using Dy on NdFeB Magnets" by Ken Ohashi, Gorham Advanced Materials Institute, Washington, Jun. 1990.

"High coercivity in Sm2Fe17Nx magnets", by K. Schnitzke et al. pp. 2853–2855, Appl. Phys. Lett. 57(26) Dec. 24, 1990.

"Pr–Fe and Nd–Pe–based materials: A new class of high performance permanent magnets" (invited), J. Appl. Phys. 55(6) Mar. 15, 1987 J. J. Croat et al., pp. 2078–2082.

"Metallurgical Methods for the Production of Rare Earth–Transition Metal Permanent Magnet Materials", by Dr. U. Koster, pp. 438–444, MPR.

"The Current Status of Titanium Rapid Solidification" by C. Suryanarayana, pp. 22–25, JOM Mar. 1990, vol. 42, No. 3.

"Thermochemical Processing of Titanium Alloys" by F. H. Froes et al., pp. 26–29 JOM, Mar. 1990, vol. 42, No. 3.

"Melting and Casting Processes for High–Temperature Intermetallics", by Subhayu Sen et al., pp. 30–35, JOM vol. 45 No. 5, May 1991.

"Processing: Key to Enhancing the Performance of the Wonder Metal", by F. H. Froes, pp. 16–21, JOM, vol. 42, No. 3, Mar. 1990.

"Magnetic Properties of R2Fe14B single crystals", by N. C. Koon et al., pp. 4091–4093 J. Appl. Phys. 57(1) Apr. 15, 1985.

"Modern Permanent Magnets for Applications in Electro–Technology", by Karl J. Strnat, pp. 923–946, Proceeding of the IEEE, vol. 78, No. 6, Jun. 1990.

"A Family of New Cobalt–Base Permanent Magnet Materials", by K. Strnat et al., pp. 1001–1002, J. of App. Phys., vol. 38, No. 3, Mar. 1, 1967.

*Primary Examiner*—John P. Sheehan

*Attorney, Agent, or Firm*—Anderson Kill Olick & Oshinsky

[57] ABSTRACT

A method for producing single-phase intermetallic phases, which melt incongruently within a temperature range of 900° to 2,000° K., with a homogeneity range of ≦10 atom % at room temperature by co-reduction is described. The exothermic reaction of the calciothermal reduction is adjusted by altering the oxide content of the reaction mixture, the composition of which corresponds to the desired single-phase alloy, in such a way that the temperature condition $T_m > T_R \geqq 0.9\ T_m$ (in ° K.) is fulfilled, $T_m$ being the melting temperature of the intermetallic phase and $T_R$ the reaction temperature. The components of the reaction mixture, with the exception of calcium, have an average particle size of ≦75 μm. The reaction product at the end of the exothermic reaction is tempered at a temperature which is at least 0.7 times the melting temperature $T_m$ of the desired, single-phase alloy, measured in ° K., but is less than the melting temperature $T_m$, during a period sufficient for the diffusion of the components.

5 Claims, 8 Drawing Sheets

METHOD FOR PRODUCING SINGLE-PHASE, INCONGRUENTLY MELTING INTERMETALLIC PHASES

FIELD OF INVENTION

Figure 1:
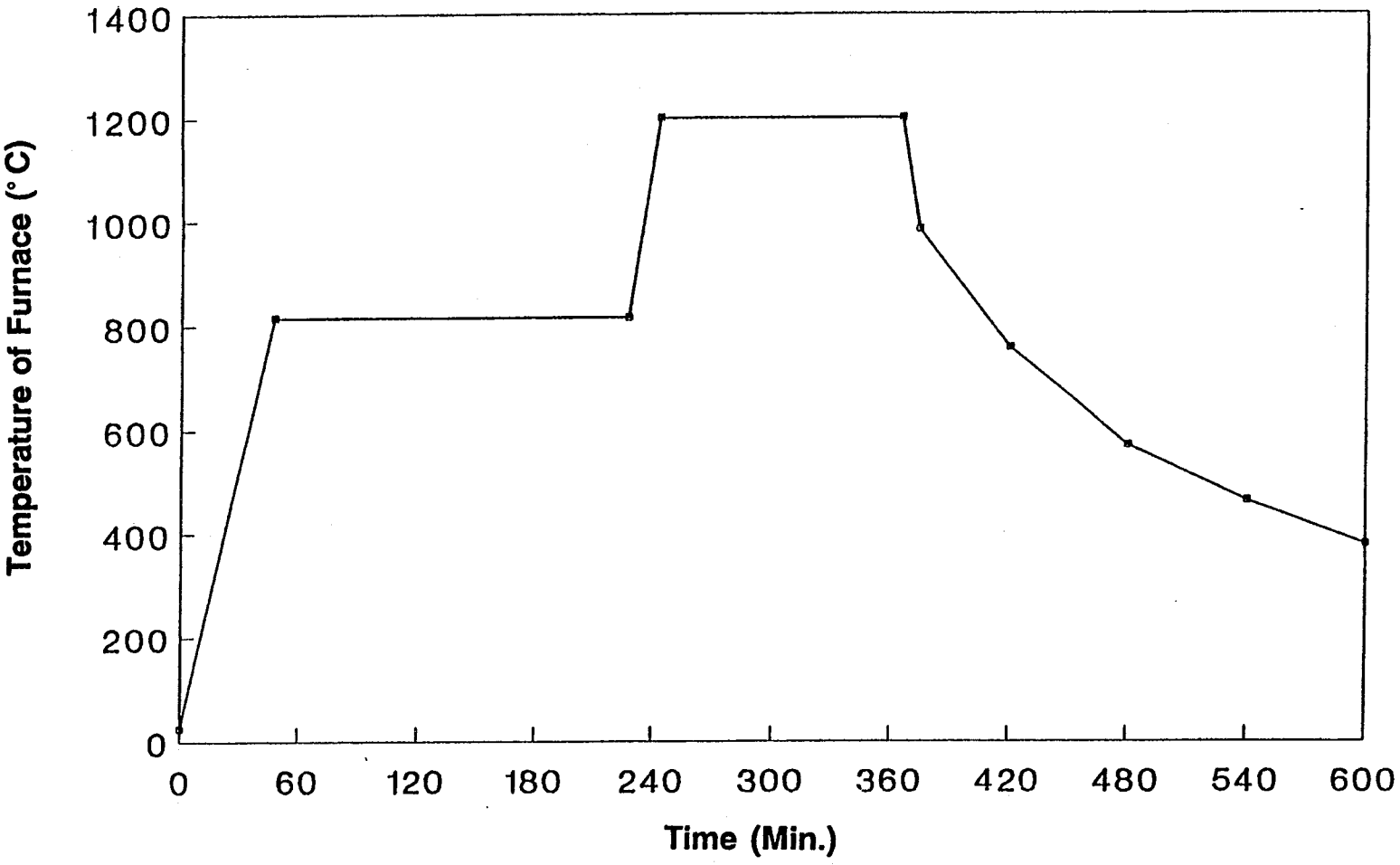

The invention is directed to a method for produring single-phase intermetallic phases, which melt incongruently within a temperature range of 900° to 2,000° K., with a homogeneity range of ≦10 atom % at room temperature. The method is performed by (a) the calciothermal reaction of a finely divided, homogeneous mixture of the alloying components, of which at least one is present in the form of an oxide; (b) the subsequent diffusion of the alloying components; and (c) the separation of the calcium oxide formed and, optionally, of the excess calcium.

BACKGROUND INFORMATION AND PRIOR ART

The properties of intermetallic compounds are somewhere between those of metals and ceramics. They frequently exhibit interesting application properties of these two classes of materials, such as high hardness, heat resistance, corrosion resistance at high temperatures, superconductivity, permanent magnetism or response to magneto-optical factors. There exist numerous investigations and publications dealing with the possible industrial applicability of intermetallic phases, of which the following publications are named as being representative: *Intermetallische Phasen, Autorenkollektiv* (Intermetallic Phases, Author Collective), published by VEB Deutscher Verlag fuer Grundstoffindustrie, Leipzig (1977); E. Fitzer in: *Warmfeste und korrosionbesstandige Sinterwerkstoffe* (Heat- and Corrosion-Resistant Sintered Materials), Metallwerk Plansee, Springer Verlag, Vienna (1956) and *Intermetallic Compounds,* J. H. Westbrook, J. Wiley & Sons, New York (1967).

Examples of such industrially used intermetallic phases are permanent alloys based on the intermetallic compound $SmCo_5$ (*J. Appl. Phys.* 38, 1001 (1967)or high-temperature materials from $MoSi_2$ (Fitzer, loc. cit.).

In many cases, the efforts to produce intermetallic compounds were finally suspended, partly because the preparation of promising intermetallic compounds failed and partly because products with the desired properties could not be obtained in an industrially usable or reproducible manner because of appreciable difficulties in the production.

Special difficulties arise with the production of intermetallic phases with an incongruent melting point. Incongruently melting intermetallic phases which are industrially important are, for example, $Er_3Co$, $ErNi_2$, $Er_3Ni$, $Fe_2Tb$, $Fe_2Nd$, $Nd_3Ni$, $Nd_2Fe_{14}B$, $SmCo_5$, $Sm_2Co_7$, $Nb_3Ge$, $Nb_3Sn$, $Nb_3Ti$, $Ni_3Al$, $Ti_3Al$ and TiAl.

The difficulties of producing single-phase, incongruently melting intermetallic compounds are described below using the intermetallic phases $Nd_2Fe_{14}B$, $Sm_2Fe_{17}$ and $\gamma$-TiAl.

1. $Nd_2Fe_{14}B$

The European patent 0 101 552 and the U.S. Pat. No. 4,756,775, to name a few publications, describe NdFeB alloys with exceptional magnetic properties.

The industrially important production methods for NdFeB are:

1. the conventional melt metallurgy with ingot casting, 2. the calciothermal co-reduction and
3. the melt metallurgy with rapid solidification.

The conventional melt metallurgy (1) comprises the calciothermal reduction of the $NdFe_3$ or the fused mass electrolysis to produce Nd metal and the subsequent vacuum inductive melting of the desired NdFeB alloy (K. Ohashi in: *Proc. of the Gorham Advanced Materials Institute,* Seattle, Wash. (1990); *Metal Powder Report,* MPR Publishing Services Ltd., Bellstone Shrewbury, Shropshire SY1HU England, 42, 6, 438 (1987)).

For the co-reduction method (2) different oxides are reduced calciothermally and transformed in a diffusion process into an NdFeB alloy. During the reduction and diffusion process, CaO is formed which is separated subsequently by wet chemical means from the NdFeB alloy (*Proc. of the 8th Intern. Workshop REPM and their Appl.,* Dayton, 587 (1985) and *Metal Powd. Rept.* 42,438 (1987)).

The NdFeB alloys, produced by methods (1) and (2), are used to produce anisotropic sintered magnets by powder metallurgical methods.

The rapid solidification method (3) also starts with the vacuum-inductive melting of a preliminary NdFeB alloy which is then spun by melt spinning (*J. Appl. Phys.* 53, 2078 (1984)). A nano-crystalline NdFeB alloy with a crystallite size of <400 nm is formed. The nano-crystalline NdFeB alloys have isotropic magnetic properties.

The NdFeB alloys, which are produced by melt metallurgical or co-reduction means and are obtainable commercially, usually have Nd or rare earth metal concentrations of 32 to 36% by weight.

In investigations of the microstructure of magnets of the composition $Nd_{15}Fe_{77}B_8$, $Nd_{14.5}Fe_{77.5}B_8$ and $Nd_{16.7}Fe_{75.5}B_{7.8}$, the $Nd_2F_{14}B$ and $Nd_{1.1}Fe_4B_4$ phases, an Nd-rich phase and $\alpha$-Fe were detected correspondingly.

The rapidly solidified, nano-crystalline NdFeB alloys usually contain Nd concentrations between 28 and 30% by weight. The spun NdFeB alloys are composed essentially of a two-phase structure of $Nd_2Fe_{14}B$ and an Nd-rich grain-boundary compound. Only small proportions of a compound of the composition $Nd_2FeB_3$ are present.

A synopsis of the permanent magnet alloys of today and of their applications is given in *Proc. of the IEEE,* 78, 6, 923 (1990). According to this, the available NdFeB alloys for sintered magnets have a remanence of $B_r$=10 to 12.8 kG, a coercivity of $iH_c$=8 to 24 kOe and energy products of $(BH)_{max}$=25 to 40 MGOe. The isotropic, spun NdFeB alloy powders have a remanence of only 8 to 9 kG, a coercive field strength of $iH_c$=15 to 17 kOe and an energy product of $(BH)_{max}$=12 to 14 MGOe. The hot-molded, anisotropic, nano-crystalline alloy powders have clearly better magnetic properties. The remanence is $B_r$=10 to 12.2 kG, the coercive field strength $iH_c$=12 to 20 kOe and the energy product $(BH)_{max}$=22 to 35 MGOe.

The essential disadvantages of melt-metallurgical or co-reduced alloys for sintered NdFeB magnets are:

1. The Curie point of the intermetallic compound $Nd_2Fe_{14}B$ is only $T_c$=596° K.; at T=423° K., a re-orientation of the aligned spin is observed. With that, the application temperature of ternary NdFeB alloys is limited to about 400° K.
2. The NdFeB magnets, which are available at the present time, have insufficient corrosion resistance which is attributed to the increased formation of an Nd-rich phase.

Magnets of nano-crystalline NdFeB powders have a lesser proportion of the Nd-rich phase. This brings about a corrosion behavior which is better than that of conventional sintered magnets.

The rapidly quenched NdFeB powders have the following summarized disadvantages:

1. The nano-crystalline alloys also have a deficient heat stability.
2. The isotropic, nano-crystalline powders, because of their isotropy, have comparatively low magnetic properties.
3. The production of nano-crystalline NdFeB alloy powders by melt spinning is a technologically expensive process.
4. The nano-crystalline NdFeB alloys are unsuitable for sintered magnets produced by powder metallurgical means.

On the other hand, of all the NdFeB alloys, the single-phase, incongruently melting, intermetallic compound $Nd_2Fe_{14}B$ has, by far, the highest saturation magnetization and the best possible corrosion behavior.

Koon et al. (J. Appl. Phys. 57, 1, 4091 (1985) investigated the magnetic properties of $R_2Fe_{14}B$ single crystals with R=Y, Nd and Tb. The single crystals were produced by means of the Czochralski method (B. N. Das, N. C. Koon: *High Performance Permanent Magnet Materials, Proceedings of the Materials Research Society,* Anaheim, USA, 96, 41 (1987)).

According to these investigations, $Nd_2Fe_{14}B$ has a saturation magnetization at room temperature of $4\pi M_s=16.2$ kG, which corresponds to a maximum, theoretically attainable energy product of $(BH)_{max}=65.6$ MGOe.

However, it was shown in numerous investigations that single phase $Nd_2Fe_{14}B$ does not have any outwardly measurable coercive field strength and only an inadequate sintering behavior. According to these investigations, a non-magnetic phase, such as the Nd-rich phase, is required in the multi-phase NdFeB sintered magnets on one hand, in order to produce a macroscopically measurable coercivity and, on the other, to promote compacting during the manufacture of the magnet by the formation of a liquid phase during the sintering process.

The European patent 0 249 973 discloses that an improvement in the magnetic properties and the corrosion resistance is possible by the separate production of $Nd_2Fe_{14}B$ and a non-magnetic sintering aid. To begin with, an NdFeB alloy having the composition $Nd_{13}Fe_{81}B_6$ and various sintering aids are melted separately by vacuum induction, milled to an average particle size of 3 μm, mixed in a ball mill, hot pressed isostatically and treated with heat. The two-phase magnet, with the composition of $(Nd_{13}F_{81}B_6)_{96}Al_4$ with $B_r=14.9$ kG, $iH_c=10.1$ kOe and $(BH)_{max}=49.7$ MGOe, has the most advantageous magnetic properties of all the magnets investigated.

The corrosion behavior of different two-phase magnets was investigated in different corrosion tests in the coated and non-coated state and compared with an $Nd_{14}Fe_{80}B_6$ sintered magnet which had been produced by conventional powder metallurgical means. For example, the NdFeB magnets were exposed to a corrosive atmosphere with a moisture content of 90% at 60° C. for a period of 100 hours. The conventionally produced $Nd_{14}Fe_{80}B_6$ magnet showed signs of corrosive attack already after one hour. On the other hand, the unfavorable two-phase $(Nd_2Fe_{14}B)_{89.5}(NdCu_2)_{10.5}$ magnet already showed a 10-fold and the most stable $(Nd_2Fe_{14}B)_{95}(Nd_{30}Fe_{40}Al_{30})_5$ a 50-fold higher corrosion resistance.

The compositions of the different structure components were determined by micro-probe analyses. According to these, the hard magnetic $Nd_2Fe_{14}B$ phase (Φ phase) has an average composition of 12.5 at % Nd, 81.5 at % Fe and 6 at % B.

According to investigations by Durst et al. (*Proc. of the 5th Intern. Symp. of Magn. Anisotropy and Coercivity in RE-Transition Metal Alloys,* Bad Soden, FRG, 2, 209 (1987)), a higher temperature stability due to an improved structure morphology is achieved by the two-phase structure of the NdFeB magnet, consisting of the hard magnetic Φ phase and a non-magnetic, Nd-rich phase.

$Nd_2Fe_{14}B$ (Φ phase) is an incongruently melting intermetallic compound with a melting point of 1180° C. At the peritectic melting point, the Φ phase decomposes into an Nd-rich melt and α-Fe which leads to a drastic decrease in the coercive field strength and is therefore to be avoided. Chin et al. (Proc. of the loth Intern. Workshop on Rare Earth Magnets, Kyoto, Japan, 2, 451 (1989)) investigated the Φ phase for a possible expansion region. According to this investigation, the Φ phase at 750° C. has only one defined composition, but at 1090° C. and 1135° C. a homogeneity range of 0.3 at %.

The stoichiometric Φ phase has a composition of 11.8 at % Nd, 82.3 at % Fe and 5.9 at % B.

This leads to the conclusion that the composition, given in the European publication 0 249 973 for the 2-14-1 phase, cannot correspond to the single-phased Φ-phase and that proportions of extraneous phases must be present.

For incongruently melting intermetallic phases, production methods based on solid reactions are to be preferred in order to avoid the incomplete peritectic formation of the desired phase which is unavoidable when cooling from the melt.

A manufacturing process for nano-crystalline alloys in the solid phase, which has been known for many years, involves the mechanical alloying of metallic alloy components. Schultz et al. (*Proc. of the 5th Intern. Symp. on Magn. Anisotropy and Coercivitity in RE-Transition Metal Alloys,* Bad Soden, FRG, 1, 301 (1987) investigated the formation of NdFeB by mechanically alloying the elementary powders and determined the magnetic properties of the nano-crystalline alloying powders prepared. It was observed that there was no formation of the intermetallic $Nd_2Fe_{14}B$ phase during the mechanical alloying. Instead, an amorphous mixture of Nd and B is formed as well as crystalline α-Fe which is alloyed with 4 to 5 at % of Nd. The hard magnetic $Nd_2Fe_{14}B$ phase is formed only in a subsequent thermal treatment by solid reaction of the nano-crystalline elementary powder mixture. An isotropic, nano-crystalline NdFeB powder is formed with magnetic properties comparable to those of the known, rapidly chilled alloy powders.

An economically and industrially accessible method for the concerted, exclusive preparation of the intermetallic $Nd_2Fe_{14}{}^B$ phase is thus not known.

2. $Sm_2Fe_{17}$

The intermetallic $Sm_2Fe_{17}$ and the compound $Sm_2Fe_{17}N_3$ obtained from it by nitration have metallurgical and magnetic properties similar to those of the $Nd_2Fe_{14}B$ phase.

Knowing the intermetallic $Nd_2Fe_{14}B$ phase, intensified research was conducted for new magnetic materials. Emphasis was placed on the different $RE_2TM_{17}$-intermetallic phases and their nitrogen compounds of the $RE_2TM_{17}N_x$ type, where RE comprises all rare earth metals including yttrium and TM comprises the metals Fe, Ni or Co. $Sm_2Fe_{17}N_3$ has proven to be particularly promising. For the preparation of the nitride, the synthesis of a single-phase $Sm_2Fe_{17}$, which was subsequently nitrated at 400° to 500° C., was attempted first.

The objects of the European publication 0 369 097 are, among others, nitrides of the composition $RE_{\alpha}Fe_{(100-\alpha-\beta-\gamma)}N_{\beta}H_{\gamma}$ with $\alpha=5$ to 20 at %, $\beta=5$ to 30 at % and $\gamma=0.01$ to 10 at %.

$Sm_2Fe_{17}$ is an incongruently melting intermetallic phase with a melting point of 1280° C. At the melting point of $Sm_2Fe_{17}$, there exists the thermodynamic equilibrium:

$$Sm_2Fe_{17}=\alpha\ Fe+Sm\text{-rich melt}$$

as described in *J. Less-Common Metals* 25, 131 (1971).

In investigating the magnetic properties of $Sm_2Fe_{17}N_{3-}$, it was noted by means of the hysteresis curve that residues of $\alpha$-Fe are still present. Such presence should be prevented if at all possible.

In order to compensate for the precipitation of $\alpha$-Fe, which is unavoidable during the melt metallurgical preparation of $Sm_2Fe_{17}$, diffusion annealing is required.

The Curie temperature of the 2/17-phase is $T_c=130°$ C. By nitrating $Sm_2Fe_{17}$ and forming $Sm_2Fe_{17}N_{3-\gamma}$, the Curie temperature is increased to $T_c=470°$ C. The saturation magnetization of the nitride was determined to be $4\pi M_s=1.54$ T. This corresponds to a theoretically attainable energy product of $(BH)_{max}$ of 59.3 MGOe.

This compound also, like the single-phase $Nd_2Fe_{14}B$, has practically no coercivity. As in the case of $Nd_2Fe_{14}B$, a coercivity can be produced by separating the grains by an intercrystalline, non-magnetic second phase similar to the Nd-rich phase.

A second possibility for obtaining a coercivity is by setting a nano-crystalline structure. Schnitzke et al. (K. Schnitzke, L. Schultz, J. Wecker, M. Katter, submitted to *Appl. Phys. Lett.*) initially synthesized a nano-crystalline $Sm_2Fe_{17}$ by mechanically alloying the elementary powder. Radiographic analyses of the powder revealed only an amorphous phase and crystalline $\alpha$-Fe. The intermetallic $Sm_2Fe_{17}$ phase is formed only during a subsequent heat treatment and was then converted by nitration to the $Sm_2Fe_{17}N_{3-\gamma}$ compound.

It is a disadvantage of these synthesis methods that only isotropic $Sm_2Fe_{17}N_{3-\gamma}$ alloys can be produced. Industrial production aiming at single phase $Sm_2Fe_{17}$ is thus not yet possible by economic means.

3. $\gamma$-TiAl

The areas of turbine manufacture, aircraft manufacture and space technology show a precipitous increase in material research in the field of intermetallic compounds. Alloys based on nickel find the most frequent application. However, the high densities of these alloys prove to be disadvantageous, for instance, in view of the centrifugal forces that arise in the turbines.

Aside from a high hardness and thermal stability, the intermetallic phases usually have a comparatively low density. This is so particularly for the aluminides of titanium. Alloys based on $Ti_3Al$ (*M R S Symp. Proc.*, Boston, 39, 221 (1985) and Z. Metallkde. 80, 5, 337 (1989)) were the first to be used industrially. However, because of a deficient oxidation resistance, their use is limited to a maximum temperature of 973° K. This contributed to aluminides of titanium with a higher aluminum content being investigated more thoroughly from the point of view of increasing the use temperature. The focus of attention of this research was directed on the aluminide $\gamma$-TiAl.

$\gamma$-TiAl solidifies through a peritectic reaction, has a melting point of 1480° C. and a homogeneity range of approximately 49 to 56 at % Al at room temperature (A. Hellwig, *Dissertation of the University of Dortmund*, Dortmund, 1990) and can be synthesized by the following methods:

thermochemical process;
vacuum induction melting;
skull melting with vacuum arc, plasma arc or electron beam;
rapid solidification from the melt; or
calciothermal co-reduction.

Further details may be found in *JOM*, 42, 3, 26 (1990); *JOM*, 43, 5, 30 (1991); *JOM*, 42, 3, 16 (1990); *Mat. Sci and Eng.*, 269 (1988) and *JOM*, 42, 3, 22, 1990).

Skull melting and the rapid solidification from the melt by, for example, melt spinning, have gained special importance for the melting of titanium alloys and aluminides of titanium.

Skull melting in the vacuum arc is a method, which has long been known and accepted as comparatively simple technologically and inexpensive. $\gamma$-TiAl solidifies incongruently so that conventional melt metallurgical methods, such as skull melting, do not ensure uniform, chemical homogeneity. By rapidly chilling from the melt, a distinctly better homogeneity of the $\gamma$-TiAl and a significantly finer grain are produced which increase the ductility at room temperature appreciably.

It is a disadvantage of the rapid chilling of TiAl from the melt that this method is more complicated technically and therefore more expensive.

Moreover, the metallic starting components of the alloy or the intermetallic phase are required for all melt metallurgical processes. Melting, moreover, is appreciably more difficult for oxygen- and/or nitrogen-affine metals, such as Ti and Al.

In contrast to melt metallurgy, the more stable and more inexpensive oxides $TiO_2$ and $Al_2O_3$ can be used as raw materials for the calciothermal co-reduction.

The European patent 0 039 0791 discloses that Ti-Al alloys with a basic composition corresponding to $TiAl_6V_4$ (based on % by weight) and different other additives can be produced by calciothermal co-reduction. An alloy powder with a homogeneous grain structure of $\alpha$- and $\beta$-Ti crystals is formed.

In the *Proc. of the 6th World Conference on Titanium*, Cannes, France, 2, 895 (1988), the calciothermal preparation of Ti-Al alloys is described and the preparation of a single phase $\gamma$-TiAl is reported. As raw material mixture, the mechanically mixed oxides or hydroxides or the calcined oxides were used. The latter were prepared by precipitation from an HCl or $H_2SO_4$ solution, annealing in air and grinding to fine powder with a particle diameter of 10 $\mu$m. The reducing temperature of the reaction mixture should be between 1173° and 1273° K. and the reducing time should be 19 to about 36 hours.

There is, however, considerable doubt as to whether the method described actually results in the formation of single-phase intermetallic alloys of the composition $\gamma$-TiA1. For example, it is known that the reduction reaction between $TiO_2$, $Al_2O_3$ and Ca is extremely exothermic and spontaneous. Therefore, when the aforementioned oxides are used exclusively, a reducing temperature of 1173° to 1273° K. and reducing times of 1 to 36 hours are improbable. Presumably, the "reducing temperature" is not meant to be the reaction temperature during the exothermic reaction but the furnace temperature. For an incongruently melting, intermetallic compound, it is not sufficient to state the furnace temperature, because the temperature must lie below the melting point of the intermetallic phase at every point in time of the process. The reaction temperature during the exothermic reducing reaction therefore also has a particular importance.

The use of hydroxides as raw materials is likewise improbable. Hydroxides decompose during the reduction process to an oxide and $H_2O$. The latter reacts further with Ca to form $H_2$ and CaO which can lead to an oxyhydrogen gas reaction and, from a safety point of view, makes the implementation of the process with hydroxides as raw materials implausible. Accordingly, this reference is also eliminated as a source that teaches the synthesis of single-phase, incongruently melting compounds of the $\gamma$-TiAl type.

OBJECT OF THE INVENTION

An object of the present invention is a method of producing single-phase, incongruently melting, intermetallic phases, the homogeneity range at room temperature of which is $\leqq 10$ atom percent.

For this purpose, the calciothermal method appears to be particularly suitable, since it starts out from the oxide raw materials, the reduction and the formation of the alloy take place in one process step in an economically justifiable time, a powdery product is formed and the process can be carried out technically without great expense.

A further object of the invention is products obtained by the above method.

SUMMARY OF THE INVENTION

It was found that the aforementioned technical problem can be solved if single-phase, incongruently melting, intermetallic phases are prepared by a calciothermal method, for the implementation of which selected process conditions are maintained.

The inventive method is characterized by the combination of the following process steps and characteristics:

a) adjusting the exothermic reaction of the calciothermal reduction by adjusting the oxide content of the reaction mixture, the composition of which corresponds to the desired single-phase alloy, in such a way that the temperature condition $T_m > T_R \geqq 0.9\ T_m$ (in ° K.) is fulfilled, $T_m$ being the melting temperature of the intermetallic phase and $T_R$ the reaction temperature;

b) use of a reaction mixture, the components of which, with the exception of calcium, have an average particle size of $\leqq 75\ \mu m$; and c) tempering the reaction product at the end of the exothermic reaction at a temperature, which is at least 0.7 times the melting temperature $T_m$ of the desired, single-phase alloy, measured in ° K., but is less than the melting temperature $T_m$, during a period sufficient for the diffusion of the components.

Characteristic a) of the inventive method consists of maintaining a particular temperature interval while carrying out the calciothermal reaction. For the inventive method, the reaction temperature must always be less than the melting temperature of the intermetallic phase, but, when measured in ° K., at least 0.9 times the melting temperature of the intermetallic phase.

For example, for using the $Nd_2Fe_{14}B$ intermetallic phase which has a melting point of 1453° K., the reaction temperature must be maintained in the range from 1308° to <1453° K. for the production by the inventive method. This temperature is to be understood as the actual reaction temperature that is measured in the reaction space, and not as the furnace temperature.

According to characteristic a), this reaction temperature is to be maintained by the oxide content of the reaction mixture and the exothermic reaction that results therefrom. Once again using the $Nd_2Fe_{14}B$ intermetallic phase as an example, only neodymium is added in the form of the oxide while the alloying partners Fe and B are added as the elements, preferably in the form of a finely divided preliminary alloy. The oxide content required for adjusting the reaction temperature is calculated from the thermodynamic data for the reactants. If necessary, the oxide content can be determined and optimized by a preliminary experiments. If the reaction temperature is to be increased, it is also possible to add boosters, such as $KClO_4$, which are known in the art.

Characteristic b), which specifies that the components of the reaction mixture, with the exception of calcium, must have an average particle size of $\leqq 75\ \mu m$, is of significant importance for the uniform course of the reaction and for ensuring that the temperature range, which is to be adhered to, is not exceeded locally. Preferably, the average particle size of the components should be $\leqq 20\ \mu m$. In particular, the average particle size of the mixture, with the exception of calcium, lies in the range of $\leqq 10\ \mu m$. The particle size can be adjusted in the known manner by means of a milling process, for example, using an attritor or an oscillating disk mill.

The calcium is added to the mixture in finely divided form, for example, in the form of chips or granulate. In so doing, care should be taken that the calcium is free of impurities, which could be taken up by the intermetallic phase. It is also possible to use $CaH_2$ instead of calcium. The hydride decomposes at the reaction temperature to calcium and hydrogen. Calcium hydride has the advantage that it is brittle and therefore can be comminuted easily.

Certain furnace-induced or method-induced losses of alloying components, which may be gaseous under the conditions of the method and may get deposited on the cooler places of the reaction furnace. These losses can be determined in a preliminary experiment and are taken into consideration in the composition of the reaction mixture by an above-stoichiometric addition.

According to characteristic c) of the inventive method, the reaction product is tempered. This tempering should be carried out in a temperature range which is given by the following temperature boundaries. The lower limit of the temperature range should be at least 0.7 times the melting temperature $T_m$ of the desired, single-phase alloy, measured in ° K. At a temperature less than 0.7 times the melting temperature $T_m$, the diffusion proceeds too slowly so that the tempering process becomes uneconomic. The upper limit of the temperature range is specified to ensure that the melting temperature $T_m$ of the desired, single-phase alloy should not be reached. The maximum tempering temperature thus should be $<T_m$, in order to obtain the desired, single-phase alloy. The tempering should be carried out during a time period sufficient for the diffusion of the constituents. For the $Nd_2Fe_{14}B$ intermetallic phase as an example, the tempering is carried out in a temperature range, which should be <1453° K. and >1017° K. Within this temperature range, a period of 1 to 20 hours is sufficient for achieving adequate diffusion.

The reaction mixture advisably is pressed into green compacts. This is known in the art and contributes to evening out the reaction mixture.

The inventive method thus is a calciothermal reduction method with subsequent diffusion of the alloying components, for which the aimed for ability to produce single-phase, incongruently melting, intermetallic phases becomes possible by maintaining a combination of selected conditions. The method enables such single-phase, incongruently melting, intermetallic phases to be produced within a wide range of applications and enriches the technique in a very special manner because of the ease with which it can be implemented and because of its universal applicability. The products obtained by the inventive method are also part of the invention.

The inventive method is to be explained in even greater detail by means of the following examples, it being understood that these examples are given by way of illustration and not by way of limitation.

EXAMPLE 1

Preparation of Single-Phase $Nd_2Fe_{14}B$

For the preparation of $Nd_2Fe_{14}B$, metallic Fe, $Fe_2O_3$, $Nd_2O_3$, $B_2O_3$ and calcium are used as raw materials. In a preliminary experiment, these raw materials are weighed out and mixed homogeneously in accordance with the desired alloy composition. Subsequently, the reaction mixture is pressed into green compacts in a press. These green compacts are filled into a reaction crucible, which subsequently is welded shut with a lid and moved into a reaction furnace. The reduction and diffusion processes take place according to the temperature program shown diagrammatically in FIG. 1. At first, the reaction mixture is degassed under vacuum at room temperature and during the first heating-up phase. Finally, the spontaneous, strongly exothermic reduction reaction commences when the temperature inside the crucible is between 500° and 800° C. When the reduction of the oxides is completed, the furnace is heated to the diffusion temperature. At the end of the diffusion, the crucible is cooled to room temperature, opened up and emptied. Subsequently, the reaction products are comminuted and the CaO is removed by wet chemical means. The leached alloy powder is filtered off, washed and dried under vacuum.

Figure 2:
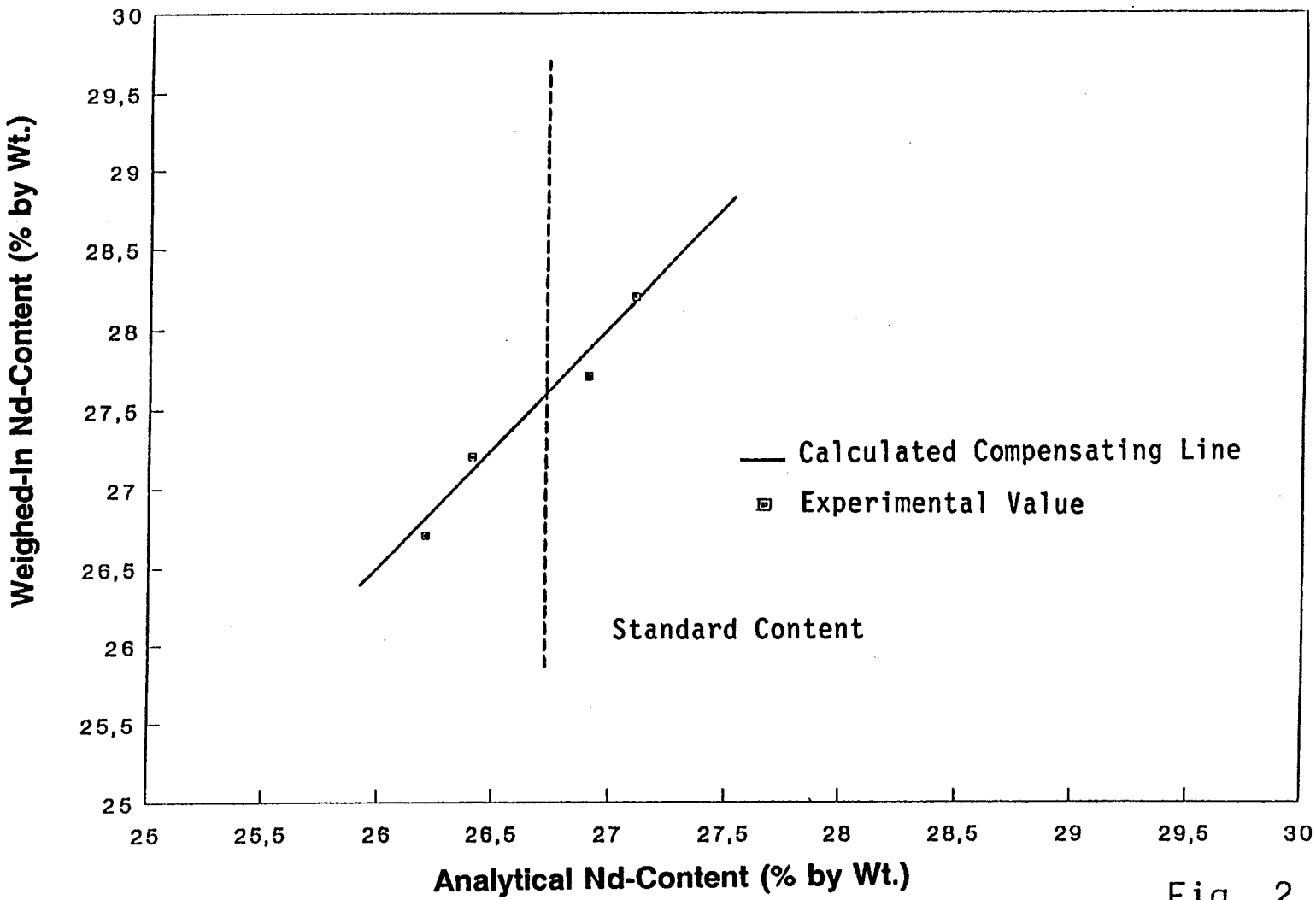

Calculating the Amount of Nd to be Weighed Out to Compensate for Furnace- and Method-induced Losses FIG. 2 shows the analytically detected Nd content in the NdFeB alloy after the co-reduction process as a function of the concentration of Nd, as $Nd_2O_3$, used in the mixture. To form the stoichiometric $Nd_2Fe_{14}B$ compound, an Nd concentration of 26.7% by weight is theoretically required. The curve of FIG. 3, obtained in preliminary experiments, shows that 27.7 to 28.2% by weight must actually be used to compensate for the losses.

Adjusting the Exothermic Reaction of the Method

Figure 3:
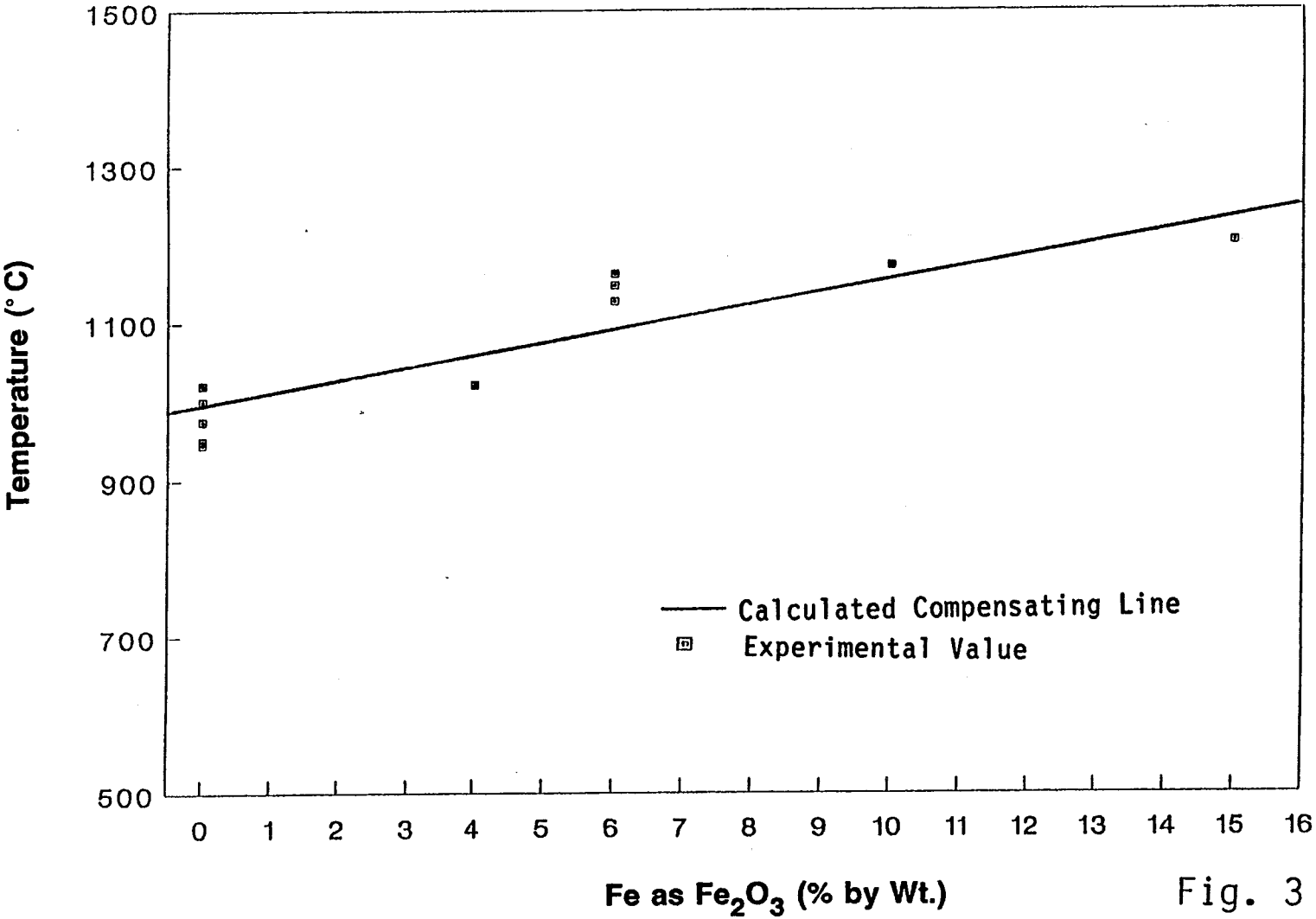

In order to prevent the temperature from exceeding the melting point, the reaction temperature in the reaction crucible is adjusted to the melting point of 1180° C. of the 2/14/1 phase by the selective addition of $Fe_2O_3$ to the reaction mixture. FIG. 3 shows the maximum temperature reached in the reaction crucible during the exothermic reaction as a function of the Fe concentration in the form of $Fe_2O_3$ in the reaction mixture. Taking into consideration the accuracy of the temperature measurement, the addition of 6% of the stoichiometrically-required metallic Fe as $Fe_2O_3$ fulfills the selection rule of the inventive method.

Taking into consideration the results of this preliminary experiment, the following reaction mixture is prepared:

| | |
|---|---|
| $Nd_2O_3$ | 1710.4 g |
| $B_2O_3$ | 184.2 g |
| $Fe_2O_3$ | 315.8 g |
| Fe | 3460.7 g |
| Ca | 1339.5 g |

The particle size of all the components, with the exception of Ca, is <75 μm.

Figure 4:
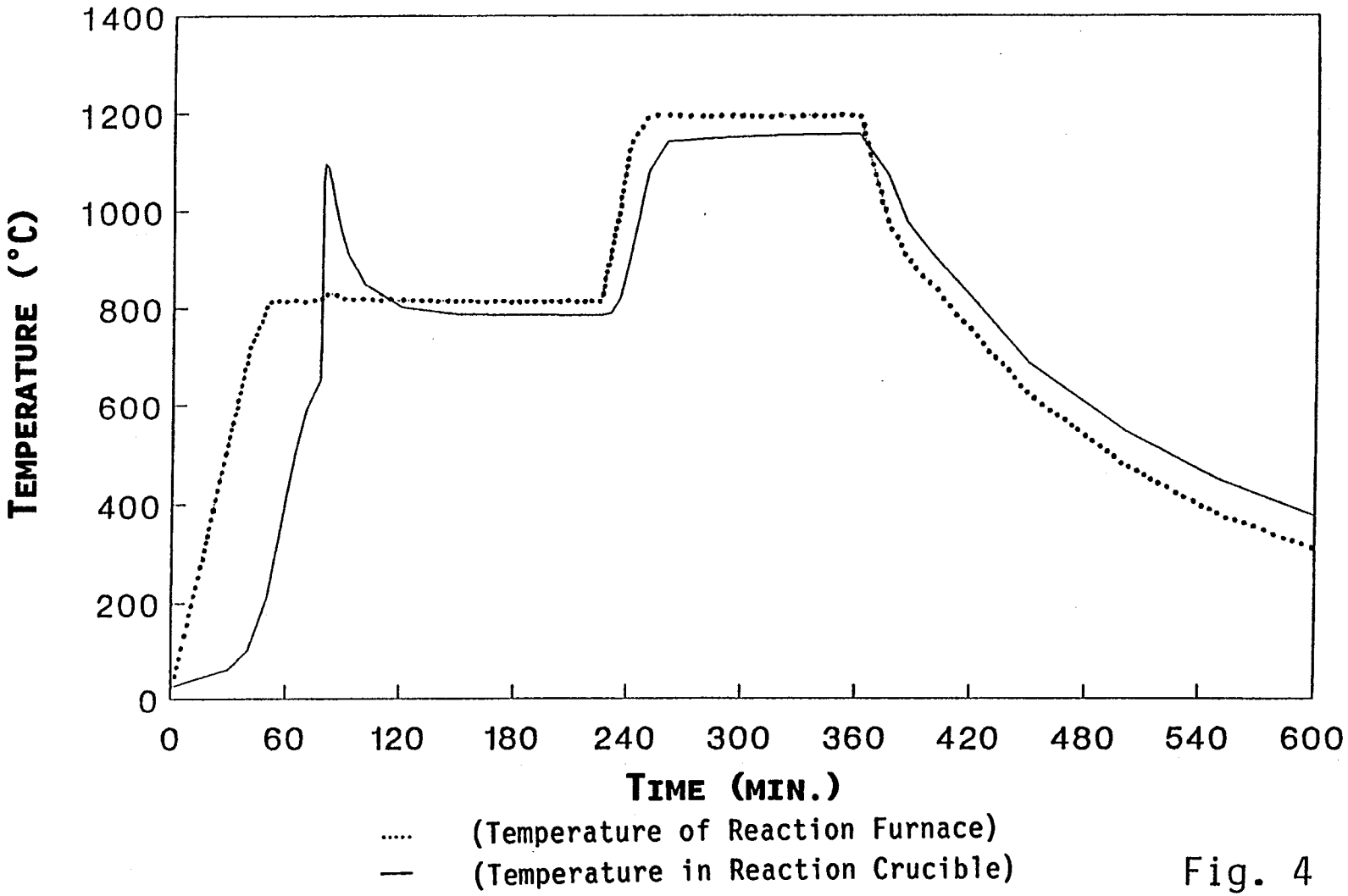

The method is carried out in accordance with the temperature program of FIG. 1. The temperatures, given in FIG. 4, are measured in the furnace and in the crucible. It can be seen that the critical temperature of 1180° C. is not reached or exceeded at any time in the crucible, that is, in the reaction mass. The maximum reaction temperature is 1110°±60° C.

Radiographic analysis of the alloy powder obtained and worked up reveals that no free Fe can be detected. In light microscopic examination, only traces of free Fe of small particle size are observed. By scanning electron microscopy with quantitative energy-dispersive X-ray analysis, only the slightest amounts of a composition, which can be assigned radiographically to the α-Fe phase, are detected.

Chemical analysis reveals the following composition.

| | % by weight |
|---|---|
| Nd | 27.10 |
| B | 1.00 |
| Ca | 0.05 |
| O | 0.24 |
| H | 0.058 |
| C | 0.041 |
| SE | 27.34 |
| Fe | balance |

With this, the composition can be described as a single-phase $Nd_2Fe_{14}B$.

If the melting temperature of the intermetallic phase is exceeded during the calciothermal reaction because of too high an $Fe_2O_3$ content or if Fe with a particle size of >75 μm is used, in some cases considerable segregation of α-Fe and the formation of interfering amounts of the undesirable $NdFe_4B_4$ is observed in the alloy formed.

EXAMPLE 2

Preparation of Single-Phase $Sm_2Fe_{17}$

For the preparation of $Sm_2Fe_{17}$, metallic Fe, $Fe_2O_3$, $Sm_2O_3$ and calcium are used as raw materials. These raw materials are weighed out in accordance with the desired composition of the alloy and mixed homogeneously. The second co-reduction process is subsequently carried out in a manner analogous to that of Example 1.

Figure 5:
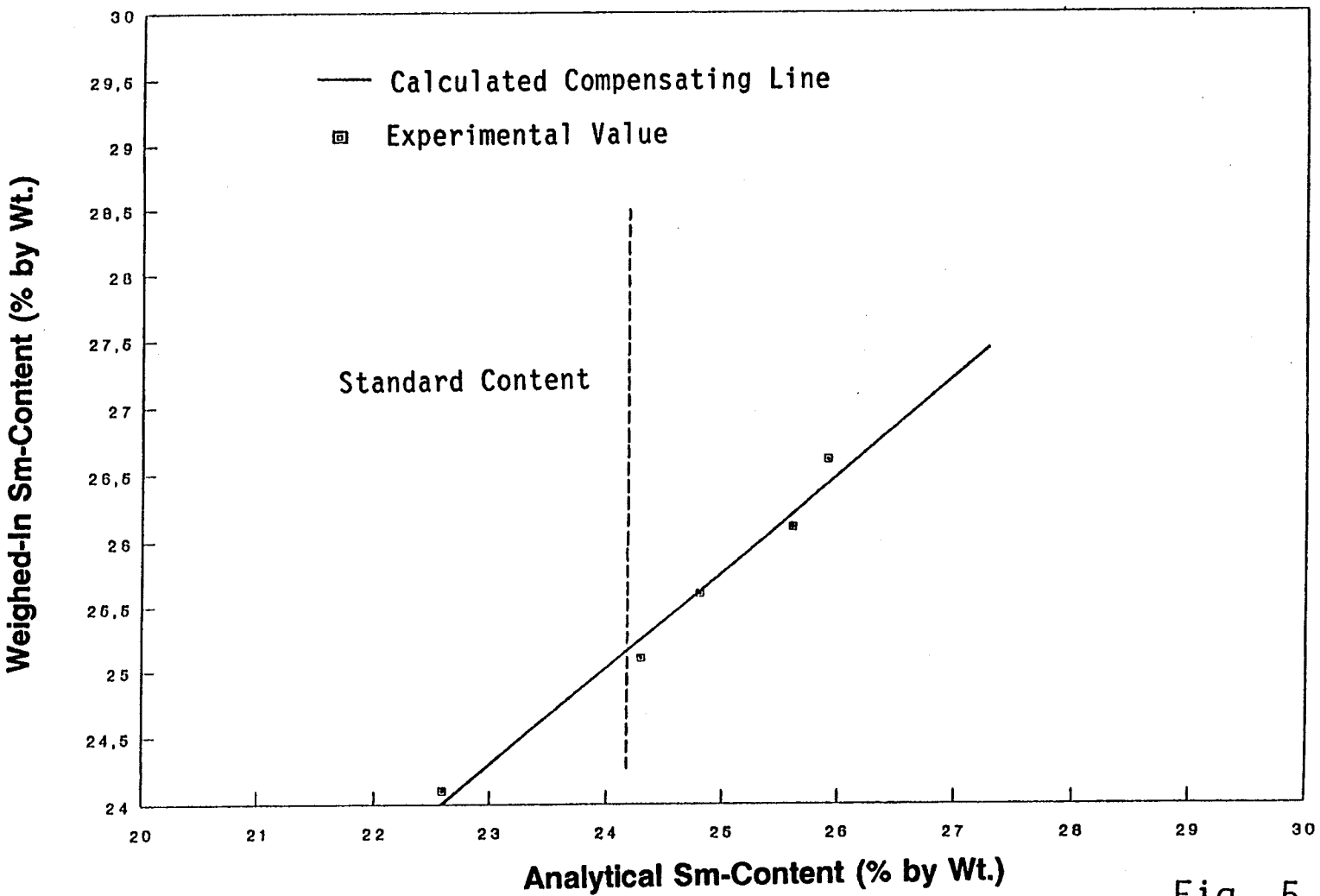

Calculation of the Amount of Sm Weighed Out to Compensate for Furnace- and Method-Induced Losses FIG. 5 shows the analytically detected Sm content in the SmFe alloy after the co-reduction process as a function of the Sm concentration as $Sm_2O_3$ used in the mixture. To form the stoichiometric $Sm_2Fe_{17}$ compound, an Sm concentration of 24.05% by weight is theoretically required. The curve of FIG. 5, which was obtained from preliminary experiments, reveals that 25.05 to 25.55% by weight should be used to compensate for losses.

Adjusting the Exothermic Reaction of the Method

Figure 6:
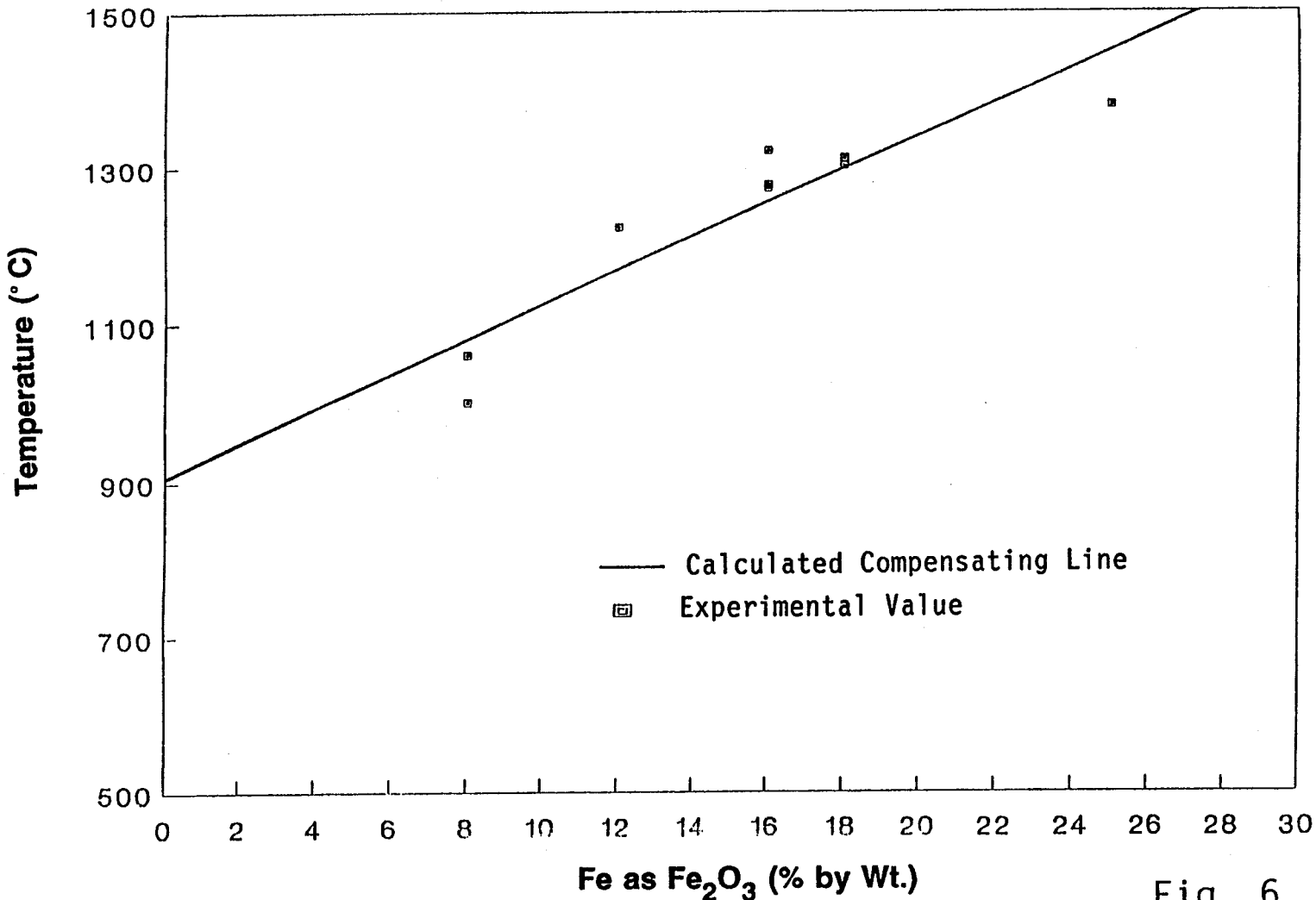

As in Example 1, the reaction temperature in the reaction crucible is adjusted by the selective addition of $Fe_2O_3$ to the reaction mixture to the melting point of the $Sm_2Fe_{17}$ of 1280° C. without exceeding the melting point. In FIG. 6, the maximum reaction temperature attained during the exothermic reaction is shown as a function of the Fe concentration in the form of $Fe_2O_3$ in the reaction mixture. Taking into consideration the accuracy of the temperature measurement, the addition of 12% of the stoichiometrically-required metallic Fe as $Fe_2O_3$ fulfills the selection rule of the inventive method.

Taking into consideration the results of these preliminary experiments, the following reaction mixture is used:

| | |
|---|---|
| $Sm_2O_3$ | 1540.6 g |
| Fe | 3406.8 g |
| $Fe_2O_3$ | 664.0 g |
| Ca | 1185.2 g |

The particle size of the raw materials mentioned, with the exception of Ca is less than 75 μm.

Figure 7:
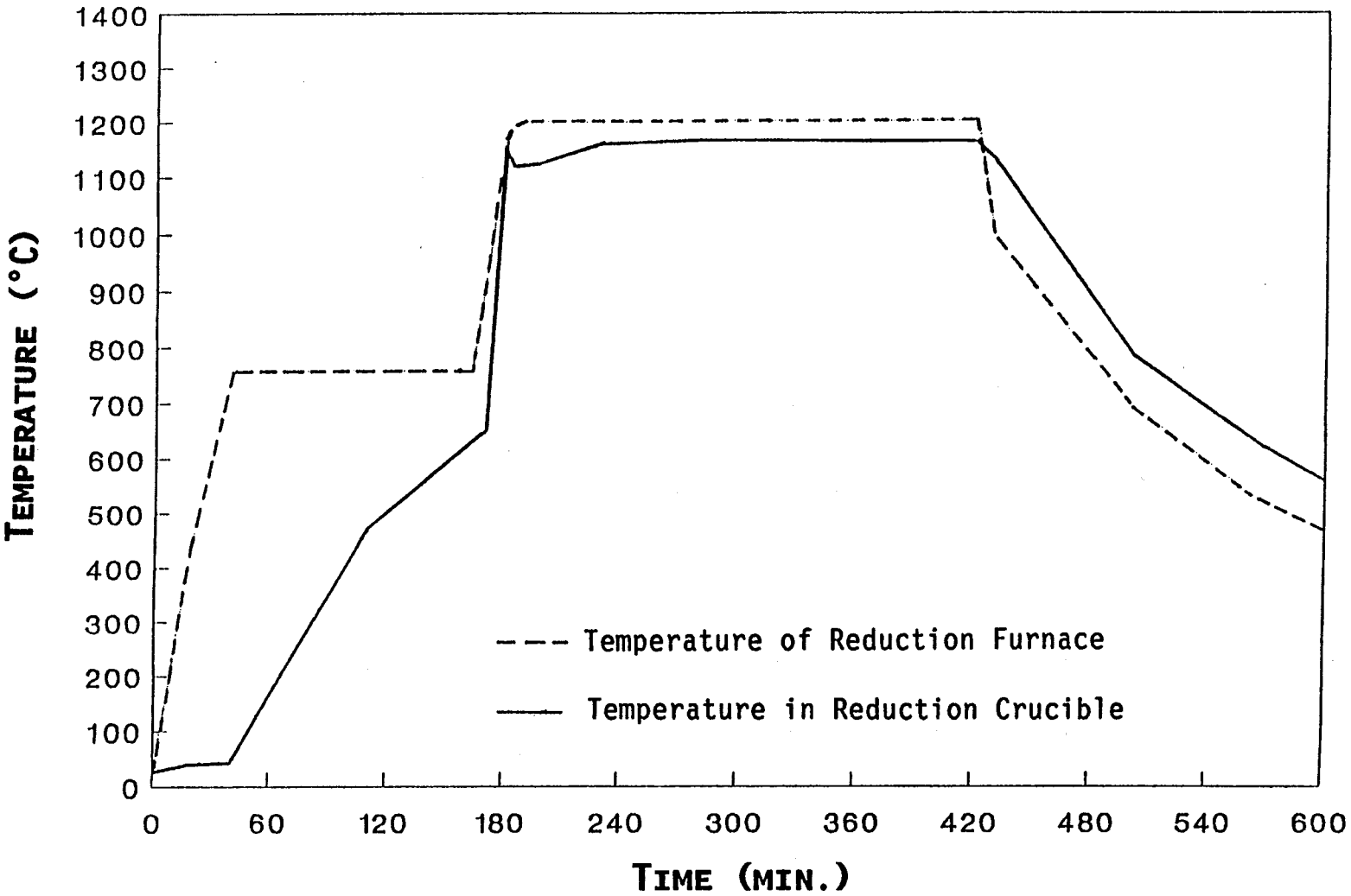

The method is carried out in accordance with the temperature program of FIG. 1. FIG. 7 shows the associated temperature course of the furnace and in the reaction mixture. At no time of the reduction and diffusion processes is the critical melting temperature of the $Sm_2Fe_{17}$ of 1280° C. reached or exceeded. During the exothermic reaction, the maximum reaction temperature measured is 1220°±5° C.

Investigations of the co-reduced $Sm_2Fe_{17}$ powder by means of X-ray diffraction, scanning electron microscopy and metallography show only traces of free α-Fe.

The chemical analysis of the $Sm_2Fe_{17}$ powder shows the following average composition;

| | % by weight |
|---|---|
| Sm | 24.60 |
| Fe | balance |
| Ca | 0.06 |
| O | 0.26 |
| H | 0.075 |
| C | 0.022 |

-continued

| | % by weight |
|---|---|
| SE | 24.7 |

With that, the composition can be described as single-phase $Sm_2Fe_{17}$.

If the melting temperature of $Sm_2Fe_{17}$ is exceeded during the exothermic reduction due to the use of too large an amount of $Fe_2O_3$ or if Fe powder with a particle size of >75 μm is used, considerable amounts of free, interfering α-Fe are observed.

EXAMPLE 3

Preparation af Single-Phase γ-TiAl

To prepare single phase γ-TiAl, metallic Ti and Al, $TiO_2$, $Al_2O_3$ and Ca are used as raw materials. These raw materials are processed further in the same manner as in Example 1. The reduction and diffusion processes are carried out in accordance with the temperature program of FIG. 8. The course of the reduction and diffusion processes and the processing of the reaction mixture are also similar to those of Example 1.

Calculating the Amount of Al Weighed Out to Compensate for Furnace- and Method-Induced Losses The losses of Al occurring were determined by varying the amount of aluminum weighed out in preliminary experiments. For the formation of a single-phase γ-TiAl, an aluminum concentration of 35.1 to 41.8% by weight is required. To compensate for the losses that occur, the amount of aluminum used actually should exceed the desired aluminum concentration by 2.8 to 3.9% by weight.

Adjusting the Exothermic Reaction of the Method

In order to avoid the temprature exceeding the melting point, the reaction temperature in the reaction crucible is adapted to the melting point of the γ-TiAl of 1480° C. by the selective addition of $Al_2O_3$ and $TiO_2$to the reaction mixture. Taking into consideration the accuracy of the temperature measurement, the addition of 74% of the total of the metallic Ti required in the form of $TiO_2$ and of the metallic Al required in the form $Al_2O_3$ is determined to be suitable and fulfills the selection rule of the inventive method.

Taking into consideration the results of the preliminary experiments, the following reaction mixture is used:

| | |
|---|---|
| $TiO_2$ | 533.8 g |
| $Al_2O_3$ | 383.6 g |
| Ti | 112.6 g |
| Al | 71.5 g |
| Ca | 1136.1 g |

The particle size of all the components, with the exception of Ca, is <75 μm.

Figure 8:
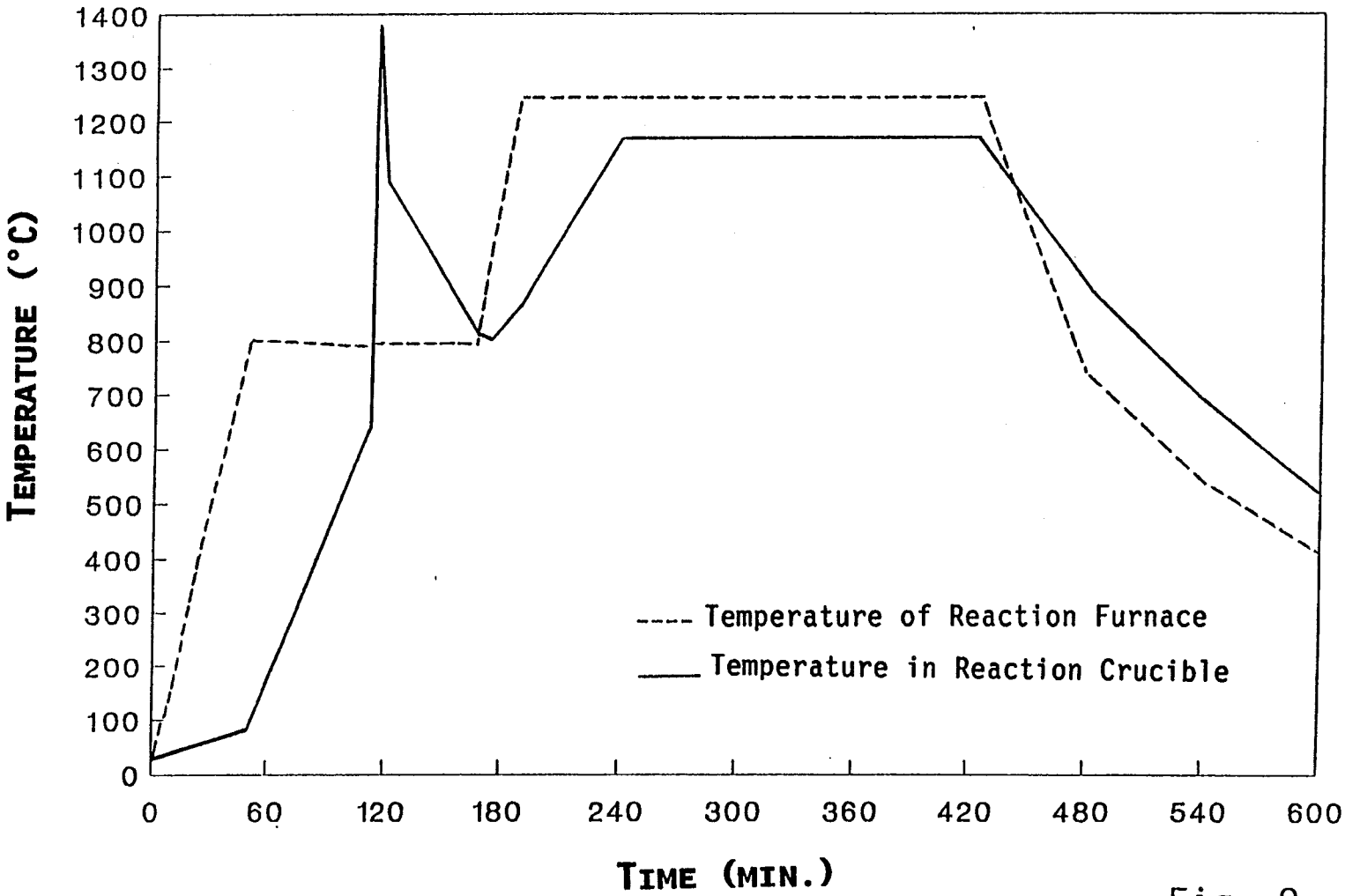

The method is carried out according to the temperature program of FIG. 8. The variation in temperature in the crucible, shown in FIG. 8, is measured. It can be seen that at no time is the critical temperature of 1480° C. reached or exceeded in the crucible, that is, in the reaction mass. The maximum reaction temperature is 1380°±70° C.

Under the light microscope, a single-phase, finely crystalline γ-TiAl is observed. Radiographic analysis shows only slight traces of $Ti_3Al$.

Chemical analysis shows the following composition:

| | % by weight |
|---|---|
| Ti | 63.4 |
| Al | 35.5 |
| Ca | 0.08 |
| O | 0.41 |
| H | 0.009 |
| N | 0.069 |
| C | 0.03 |

With that, the above-named composition, with Ti 50.15, Al 49.85 at % , can be described as a one-phase composition.

If the melting temperature of the γ-TiAl is exceeded during the calciothermal co-reduction through the use of too high an amount of oxide or if Ti with a particle size >75 μm is used, a considerable, uniform distribution of unalloyed Ti and increased formation of the undesirable $Ti_3Al$ phase are observed.

We claim:

1. A method for preparing single-phase intermetallic phases of $Nd_2Fe_{14}B$, $Sm_2Fe_{17}$ and TiAl capable of melting incongruently, within a temperature range of about 900° to 2,000° K., said phases having a homogeneity range of ≦10 atom % at room temperature, said preparation being accomplished by a) reducing calciothermally a finely divided, homogeneous mixture of alloying components, of which at least one is present in the form of an oxide, the reduction being an exothermic reaction, b) subsequently diffusing the alloying components, and c) separating the formed calcium oxide and, optionally, the excess calcium, said method comprising the combination of the following steps:

i) adjusting the exothermic reaction of calcio thermal reduction by adjusting the oxide content of reaction mixture, the composition of which corresponds to the desired single-phase alloy so that the temperature condition $T_m > T_R \geqq 0.9\ T_m$ (in ° K.) is fulfilled, $T_m$ being the melting temperature of the intermetallic phase and $T_R$ the reaction temperature;

ii) carrying out the method with the reaction mixture, the components of which, with the exception of calcium, have an average particle size of ≦75 μm; and iii) tempering the reaction product obtained at the end of the exothermic reaction at a temperature at least 0.7 times the melting temperature $T_m$ in ° K. of the single-phase alloy but less than the melting temperature $T_m$ during a period sufficient for the diffusion of the components.

2. The method of claim 1, further comprising determining possible method- and apparatus-induced losses of alloying components, and adding alloying components in stoichiometric amounts in the reaction mixture to compensate for determined losses.

3. The method of claims 1 or 2, comprising that the components in the reaction mixture, with the exception of calcium, have an average particle size of ≦20 μm.

4. The method of claims 1 or 2, comprising that the components in the reaction mixture, with the exception of calcium, have an average particle size of ≦10 μm.

5. The method of claims 1 or 2, further comprising compressing the reaction mixture into green compacts before reducing calcio thermally the homogeneous mixture of alloying components.

* * * * *